US006926019B2

(12) United States Patent
Glatz

(10) Patent No.: US 6,926,019 B2
(45) Date of Patent: Aug. 9, 2005

(54) UMBRELLA SHAFT, AND UMBRELLA HAVING SUCH AN UMBRELLA SHAFT

(75) Inventor: Gustav Adolf Glatz, Frauenfeld (CH)

(73) Assignee: Glatz AG (CH)

( * ) Notice: Subject to any disclaimer, the term of this patent is extended or adjusted under 35 U.S.C. 154(b) by 0 days.

(21) Appl. No.: 10/198,560

(22) Filed: Jul. 18, 2002

(65) Prior Publication Data

US 2003/0015230 A1 Jan. 23, 2003

(30) Foreign Application Priority Data

Jul. 23, 2001 (CH) ..... 1360/01

(51) Int. Cl.[7] ..... A45B 25/00
(52) U.S. Cl. ..... 135/20.3; 135/20.1; 135/21
(58) Field of Search ..... 135/20.3, 20.1, 135/21, 98, 15.1, 90, 42

(56) References Cited

U.S. PATENT DOCUMENTS 4,386,621 A * 6/1983 Redl ..... 135/20.3
5,845,665 A * 12/1998 Koehn ..... 135/98
6,014,980 A * 1/2000 Glatz ..... 135/20.1
6,182,917 B1 * 2/2001 Lai ..... 242/390.8
6,230,724 B1 * 5/2001 Lai ..... 135/20.3
6,401,739 B1 * 6/2002 Bright et al. ..... 135/98
6,435,444 B1 * 8/2002 Lin ..... 242/396.6
6,616,129 B1 * 9/2003 Lee ..... 254/266

* cited by examiner

*Primary Examiner*—Janet M. Wilkens
(74) *Attorney, Agent, or Firm*—George Pappas

(57) ABSTRACT

Umbrella shaft for a hanging umbrella, having a shaft part (20,26) and a rope drive (22), which connects a slide (16) and a crown (8) of the umbrella, the slide and the shaft part being coupled axially to one another when the umbrella is open. In order to improve the operability, the rope drive is designed as a rope winch (22) which can be connected to the slide (16), the rope (28) running essentially coaxially with the axis of the umbrella shaft.

21 Claims, 6 Drawing Sheets

UMBRELLA SHAFT, AND UMBRELLA HAVING SUCH AN UMBRELLA SHAFT

TECHNICAL FIELD

The invention relates to an umbrella shaft for a hanging umbrella.

PRIOR ART

An umbrella shaft or an umbrella of the type mentioned in the introduction is known, for example, from CH-A-661 189, the rope drive comprising a block and tackle which is arranged between the slide and the crown of the umbrella. The block and tackle is awkward to handle, the accessibility being rendered more difficult, in particular in the case of relatively large umbrellas in the closed state of the umbrella. Moreover, the block and tackle is exposed, with the result that the lengths of rope of the block and tackle are difficult to stow away when the umbrella is open and have an adverse effect on the appearance of the open umbrella.

CH-A-367 290 and 666 166 disclose umbrellas which are each hung in a removable manner on an extension arm by means of a ball-and-socket joint, the extension arm extending transversely to a stand. The umbrella is opened by hand, in which case the canopy first of all has to be opened some way by hand in order that it is then possible to reach into the umbrella from beneath and grip the slide in order to move it towards the crown of the umbrella and latch it thereto in the open state. This opening operation is very laborious in the case of large umbrellas in particular since relatively large forces are necessary and, furthermore, the accessibility is made more difficult.

Umbrellas which are arranged on an extension arm connected to a stand and which can be opened and closed via a rope pull are also known. One end of the rope pull is connected to the slide of the umbrella. The rope of the rope pull then runs over the crown and the extension arm as far as a rope winch in the stand or extension arm. Such an umbrella, although easy to handle, cannot be removed from the extension arm, as is the case with the abovementioned umbrellas, without the rope connection having to be released.

DESCRIPTION OF THE INVENTION

The object of the invention is to provide an umbrella shaft of the type mentioned in the introduction which makes it possible to improve hanging umbrellas.

This object is achieved according to the invention by providing an umbrella shaft for a hanging umbrella, having a shaft part and a rope drive which connects a slide and a crown of the umbrella, the slide and the shaft part being coupled axially to one another when the umbrella is open, characterized in that the rope drive is designed as a rope winch which can be connected to the slide, the rope running essentially coaxially with the axis of the umbrella shaft.

Since the rope drive is designed as a rope winch which can be connected to the slide, and since the rope runs coaxially with the shaft axis, this provides a drive which is easily accessible, is easy to operate and, furthermore, blends in harmoniously with the design of the umbrella. In particular the rope is accommodated in a protected manner in the umbrella shaft, with the result that laborious stowage operations are dispensed with and there is no adverse effect on the appearance of the open umbrella. Moreover, such an umbrella shaft makes it possible to have an umbrella which can be removed from an extension arm without the rope connection also having to be released. Moreover, the umbrella shaft does not obstruct the extension arm from being extended and retracted.

The rope winch may be arranged in any desired form directly or indirectly on a slide, but the design is advantageous since, in this case, the rope winch can be inserted into an opening of the slide of an umbrella, and connected to the same, by means of the shaft part. It is possible for the shaft part to be assigned exclusively to the slide and to latch with an opening in the crown when the umbrella is opened. An advantageous configuration, however, is wherein the shaft part can be connected to the crown of the umbrella. A particularly preferred configuration is wherein both the slide and the crown are assigned a shaft part, it being possible for the two shaft parts to be coupled to one another in the open state of the umbrella, and preferably one shaft part having a profiled pin and the other shaft part having a bushing with the corresponding mating profile, with the result that a torque can be transmitted via the shaft parts.

The rope winch may be equipped with an electric drive. A more advantageous design, however, is the design wherein a hand crank is provided. The rope winch is expediently equipped, with a latching device for latching purposes when the umbrella is opened and, with a braking device for controlled closure of the umbrella. The latching device and the braking device are advantageously combined with one another and can be operated by the hand crank. There are advantages in these configurations of this combined latching and braking device. Particularly expedient developments are those wherein the latching device is assigned a free-running device, which switches off the braking device and the latching device and allows the umbrella to quickly.

The configuration of the umbrella shaft with the handle, is particularly advantageous, in particular in the annular development thereof, since the handle makes it easier to grip the slide, and thus the rope winch, without the user first having to reach into the umbrella and open the latter some way beforehand. The handle also makes it easier to operate the rope winch with the hand crank. The annular handle in particular, in addition, covers the hand crank when the latter is oriented downward, as a result of which, on the one hand, the hand crank is protected against damage, and, on the other hand, the user is protected against being injured by a projecting hand crank. The handle, furthermore, may perform an additional operating function for transporting a torque, in order for example for the shaft part to be screwed into a crown of the umbrella, and interact with a ball-and-socket joint, by way of a threaded bolt, in order to block or release said ball-and-socket joint.

The umbrella shaft may be configured as an independent component and serve for subsequent installation or the exchange of an umbrella shaft in an existing umbrella, in order, in the case of such an umbrella, to eliminate the disadvantages mentioned in the introduction and achieve advantages. However, it is also possible for an umbrella to be equipped directly with the umbrella shaft according to the invention.

BRIEF DESCRIPTION OF THE DRAWINGS

Exemplary embodiments of the invention are described in more detail hereinbelow with reference to the drawings, in which.

METHODS OF IMPLEMENTING THE INVENTION

Figures 1, 2:
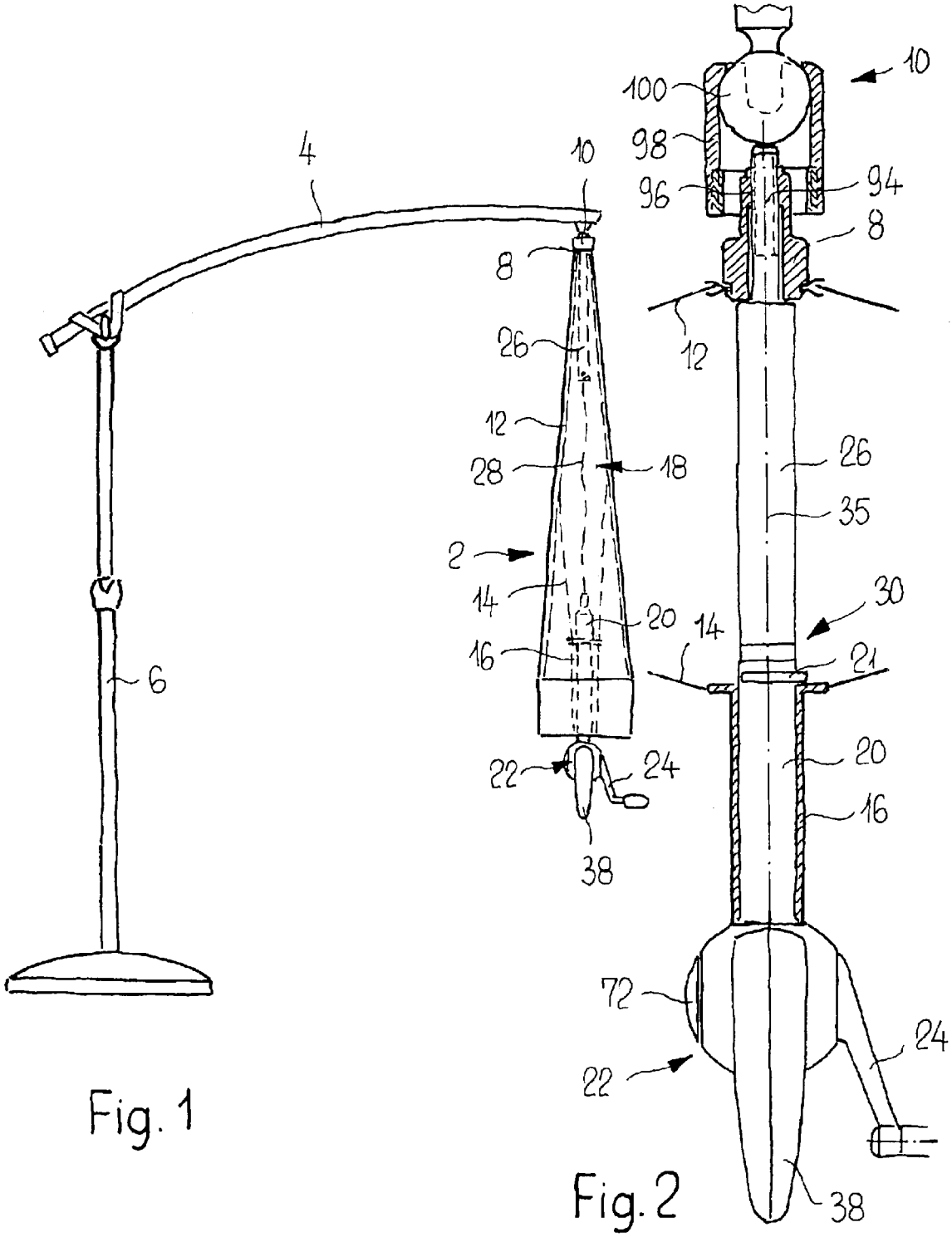
FIG. 1 shows an umbrella which is hung on an extension arm and is in the closed state.
FIG. 2 shows, on an enlarged scale, a side view of the umbrella shaft used for the umbrella from FIG. 1, the umbrella being open.

FIG. 1 shows an umbrella 2 in the closed state, the umbrella being arranged on an extension arm 4 which is fastened in an extensible manner on a stand 6. Such an umbrella is known, for example, from CH-A-367 290 and 666 166. This known umbrella 2 has an umbrella framework which contains a crown 8, which is connected to the extension arm 4 via a ball-and-socket joint 10. Articulated on the crown 8 are canopy rods 12, which are supported on a slide 16 via supporting rods 14. The slide 16 and a crown 8 are connected to one another via an umbrella shaft 18.

The umbrella shaft 18 designed according to the invention contains a first, bottom shaft part 20, which is connected to the slide 6, said shaft part being inserted into an opening of the slide 16 and being secured against sliding out by means of a securing means 21. Arranged at the bottom end of the shaft part is a rope winch 22, which is actuated by a hand crank 24. The umbrella shaft 18 also contains a second, top shaft part 26, which is connected to the crown 8. When the umbrella is closed, according to FIG. 1, the first shaft part 20 and the second shaft part 26 are separated from one another and are only connected to one another via a rope 28 of the rope winch 22. When the umbrella is open, the shaft parts 20 and 26 are connected to one another via a coupling device 30, as can be gathered from FIGS. 2 and 3. The coupling device 30 is formed by a profiled pin 32, which is located on one of the shaft parts 20 and interacts with a bushing 34 of the other shaft part 26, the bushing being provided with a corresponding mating profile 36 in order to achieve a rotationally fixed connection between the shaft parts 20, 26. The rope 28 is guided through the shaft parts 20, 26, which are of hollow design, essentially coaxially with the axis 35, and is fastened on the inside of the bushing 34 of the coupling device 30 by means of a lead seal 37 or a knot.

Figure 3:
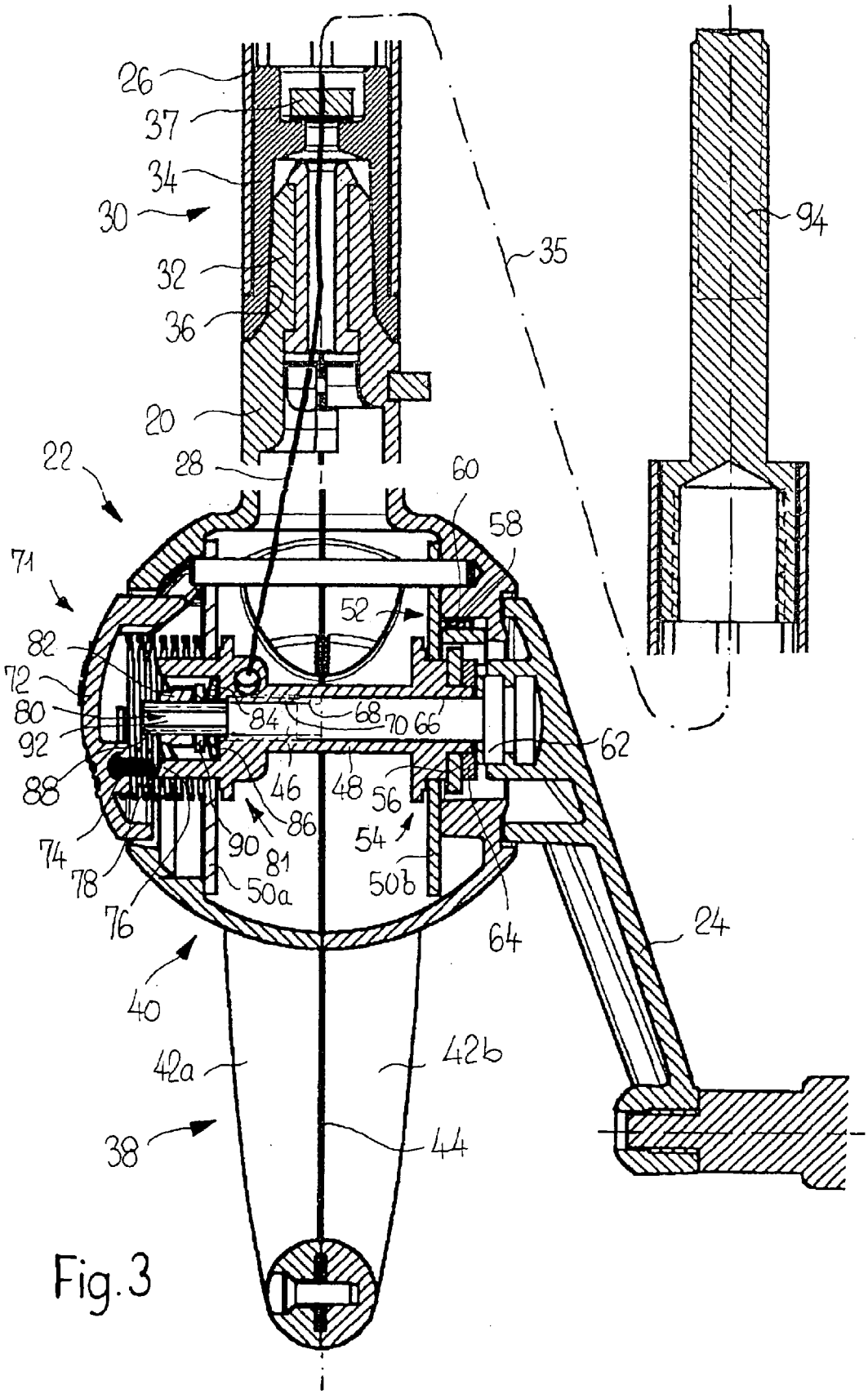
FIG. 3 shows, on an enlarged scale, a vertical section through the umbrella shaft from FIG. 2.
Figure 4:
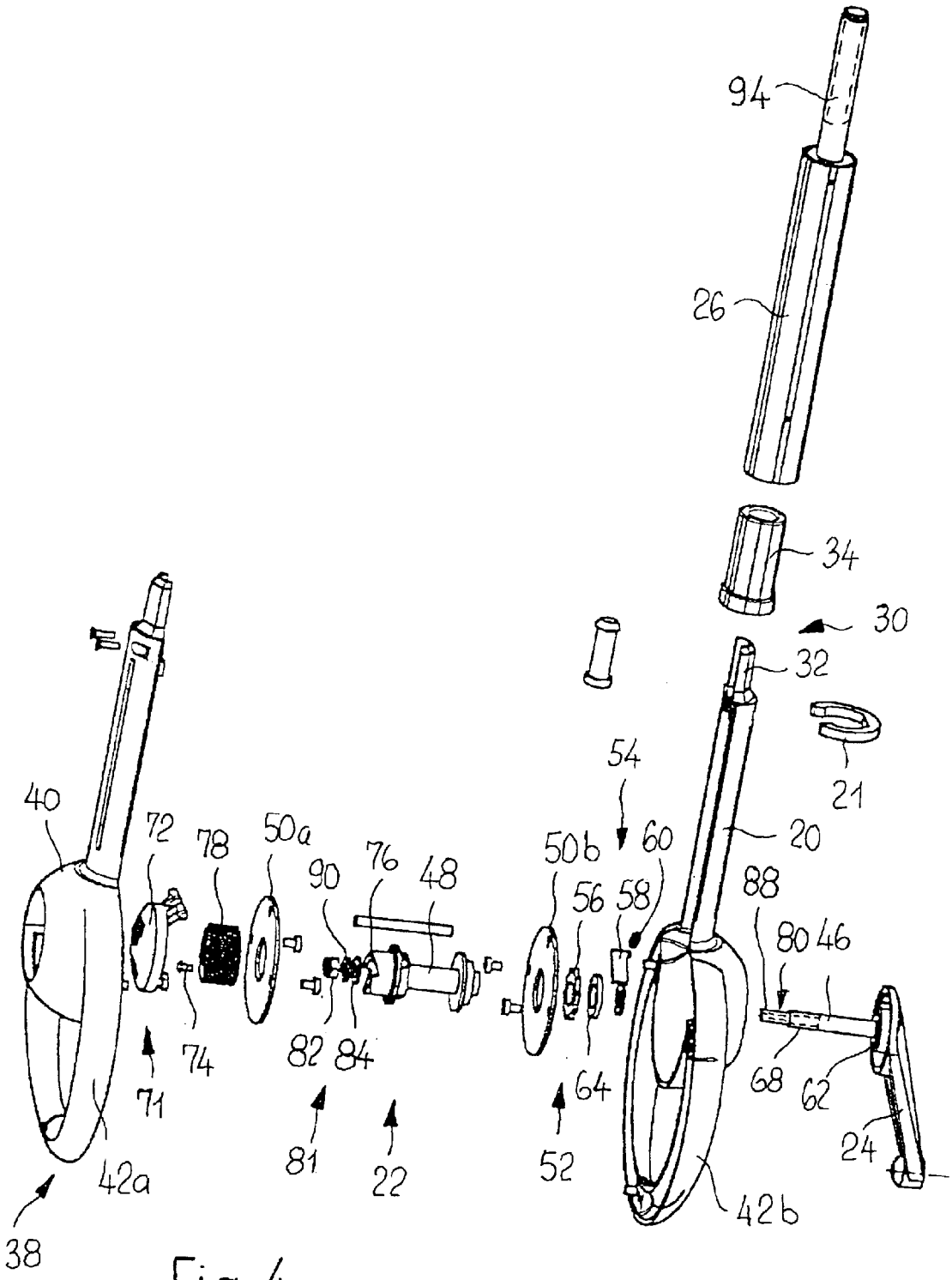
FIG. 4 shows an exploded illustration of the umbrella shaft from FIGS. 2 and 3.

Details of the design of the umbrella shaft 18 can be gathered from FIGS. 3 and 4.

The first shaft part 20 has the rope winch 22 with the hand crank 24. Furthermore, the first shaft part 20 is equipped with an annular handle 38, which extends downward transversely to the spindle of the rope winch 22 and is integrally formed on the housing 40 of the rope winch. In the present example, the first shaft part 20, the housing 40 of the rope winch 22 and the annular handle 38 are configured in one piece and are formed from two shaped halves 42*a* and 42*b* which butt against one another in a vertical center plane 44, which is aligned transversely to the spindle of the rope winch 22.

The rope winch 22 is formed from the hand crank 24, which is fastened on a spindle 46, which is mounted in a rope drum 48. The rope drum, for its part, is mounted in bearing plates 50*a*, 50*b* of the housing 40. The rope drum serves for winding up the rope 28 and for unwinding the same. The rope winch 22 is equipped with a latching device 52 in order to retain the umbrella framework, and thus the umbrella, in the open state. This latching device is combined with a braking device 54, which allows the umbrella to be closed in a controlled manner.

The latching device 52 comprises a latching ring 56, which can be rotated freely on the rope drum 48 and on which there acts a detent 58, which is mounted in the housing 40 and is prestressed against the latching ring by means of a spring 60. The spindle 46 is positioned against the latching ring 56 via a flange 62 and a brake disk 64. The spindle 46, which is arranged coaxially in an opening 66 of the rope drum 48, is connected thereto via a threaded connection and, for this purpose, has an external thread 68, which interacts with an internal thread 70 of the opening 66 of the rope drum.

The rope winch 22, with the latching device 52 and the braking device 54, functions as follows:

If the hand crank 24 is rotated in the clockwise direction in order to open the umbrella, then the external thread 68 of the spindle 46 is screwed further into the internal thread 70 of the rope drum 48, which is braked by the tension of the rope 28, as a result of which the flange 62 of the spindle 46 presses the brake disk 64 against the latching ring 56 and fixes the latter on the rope drum 48. The hand crank 24 is thus connected to the rope drum 48 and the rope 28 can be wound up, the detent 58 on the latching ring 56 preventing the rope drum from rotating back. If the umbrella is to be closed, then the hand crank 24 is moved in the anticlockwise direction, as a result of which the spindle 46 is unscrewed out of the rope drum 48 via the external thread 68 and the pressing action of the flange 62 on the brake disk 64 loosens in a manner of a slip clutch. As soon as the braking force of the brake disk 64 becomes smaller than the tensile force of the rope 28 on the rope drum 48, the action of the latching device 52 is eliminated and the rope 28 begins to run off from the rope drum 48. If the hand crank 24 is stopped, then the tensile force of the rope causes the rope drum 48 to continue to rotate and thus causes the external thread 68 and the internal thread 70 to be tightened, as a result of which the braking force on the brake disk 64 increases until the rope drum 48 comes to a standstill. It is only by virtue of the hand crank 24 being rotated back again in the anticlockwise direction that the rope 28 can unwind and the operation of closing the umbrella can thus be set in motion again. This makes it possible for the umbrella to be closed in a controlled manner.

For rapid closure of the umbrella, the rope winch 22 is also equipped with a free-running device 71 with a free-running button 72, which is arranged on that side of the housing 40 which is directed away from the hand crank 24. The free-running button 72 contains a retaining pin 74, which can be moved against an arresting profile 76 of the rope drum 48 counter to the force of a prestressing spring 78. The free-running device 71, furthermore, contains an axial extension 80, arranged on that side of the spindle 46 which is directed away from the hand crank 24, with a blocking device 81, which bears a stop 82 which interacts, via a spring 84, with the facing end side 86 of the rope drum 48. The axial extension 80 has a thread 88 which bears the stop 82, which is designed as a nut. A securing ring 90 with a radially inwardly oriented latching nose engages in a groove 92 in the axial extension 80 of the spindle, in order to prevent the stop 82 from being adjusted in an undesirable manner.

The free-running device 71 functions as follows:

Upon actuation of the free-running button 72, the retaining pin 74 is brought into engagement with the arresting profile 76 of the rope drum 48 and blocks the rope drum 48.

In this state, the hand crank 24 can be rotated further in the anticlockwise direction until the external thread 68 and the internal thread 70 are released to the extent where there is no frictional connection between the brake disk 64 and the latching ring 56. At the same time, the stop 82 presses the spring 84 against the end side 86 of the rope drum 48, with the result that the rope drum 48 and the spindle 46 are blocked and the external thread 68 and the internal thread 70 cannot move relative to one another any longer. This prevents the brake disk 64 from being able to act on the latching ring 56. If the free-running button 72 is then released, the rope 28 unwinds from the rope drum 48 under the tensile action of the rope 28 and rotates the rope drum 48 and the hand crank connected thereto. The blocking of the blocking device 81 is eliminated and the braking device 54 and the latching device 52 are reactivated when the hand crank 24 is moved with increased rope tensioning in the clockwise direction, that is to say in the opening direction of the umbrella, as a result of which the stop 82 is freed from the end side 86 and the clamping action of the brake disk 64 begins to take effect again.

As can be gathered from FIGS. 1 and 2, the second shaft part 26 is connected to the crown 8, which is fastened on the ball-and-socket joint 10. For this purpose, the top shaft part 26 has a threaded bolt 94, which is screwed into a threaded opening 96 of the crown 8. The crown is connected to a ball socket 98 via a bayonet closure, which is not illustrated specifically here (details on this can be gathered from CH-A-666 166). The threaded bolt 94, then, can be screwed into the crown 8 or the ball socket 98 to the extent where is comes into engagement with the ball head 100 of the ball-and-socket joint 10 directly or indirectly via an intermediate element. By virtue of the annular handle 38 being rotated in the clockwise direction, the threaded bolt 94 can be prestressed against the ball head 100 and can arrest the ball-and-socket joint 10, as a result of which the umbrella can be secured in a desired position. By virtue of the annular handle 38 being rotated in the anticlockwise direction, this blocking can be eliminated again and the umbrella can swing freely on the extension arm 4. By virtue of the annular handle 38 being rotated back further in the anticlockwise direction, the threaded bolt 94 can open the connection to the ball-and-socket joint to the extent where the crown 8 can be removed, in a manner which is not illustrated, from the ball-and-socket joint by virtue of the bayonet closure being released.

Figure 5:
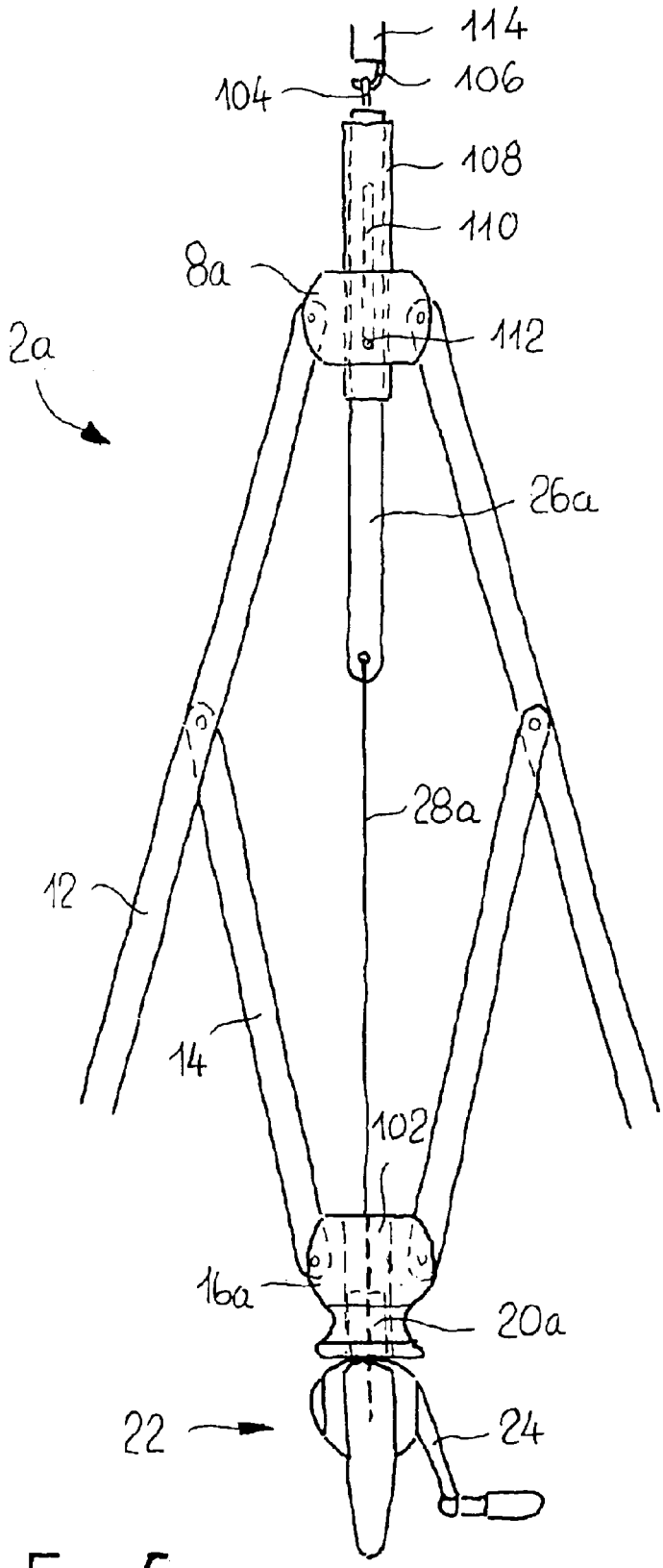
FIG. 5 shows a side view of the framework of a further umbrella, in a slightly open state.
Figure 6:
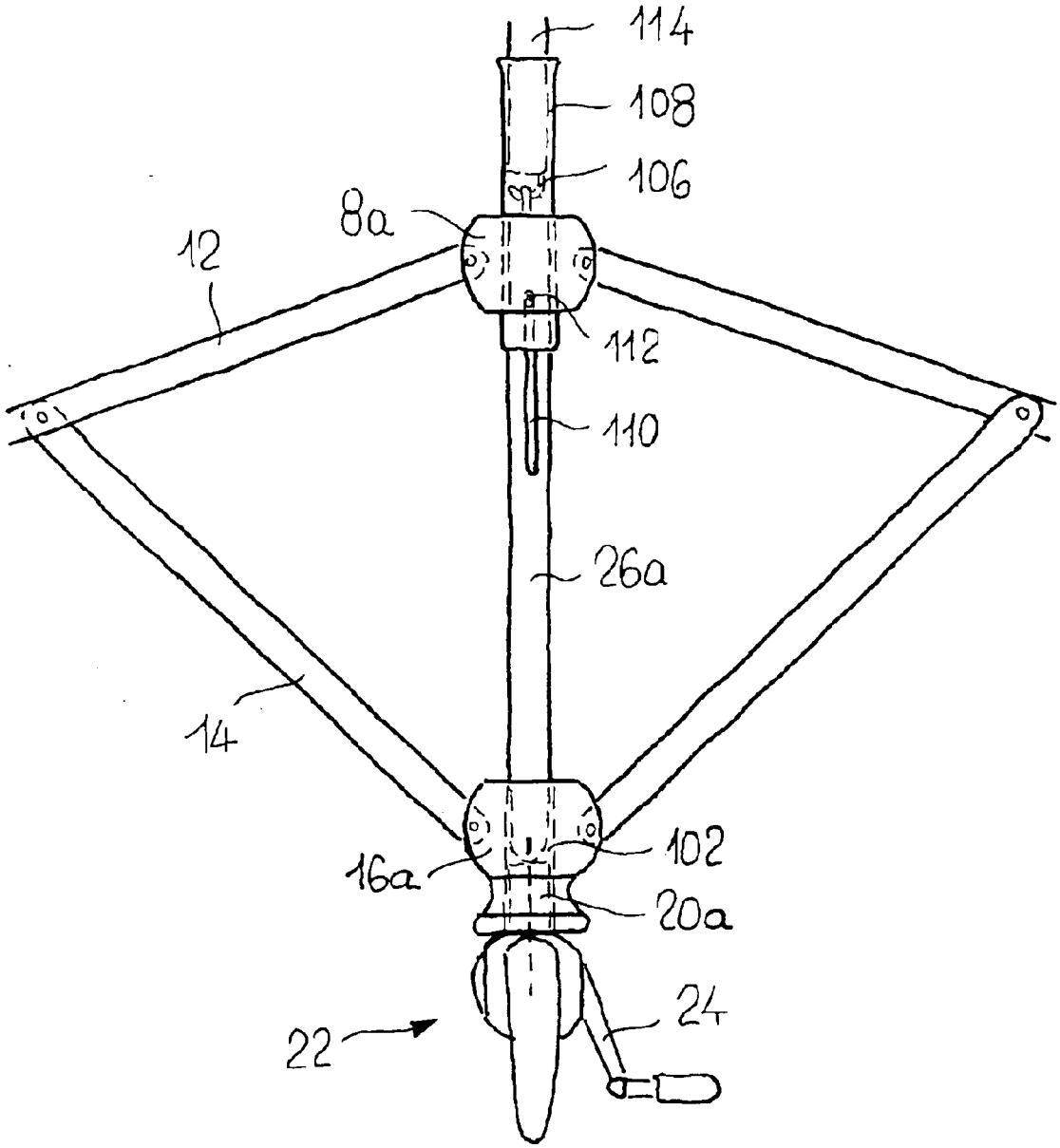
FIG. 6 shows the umbrella from FIG. 5 in the fully open state.

FIGS. 5 and 6 show a further exemplary embodiment of an umbrella shaft 18*a* on an umbrella 2*a*, to be precise in a modification of the umbrella according to CH-A-661 189. The first shaft part 20*a*, which is connected to the rope winch 22, is only of very short design and serves exclusively for fastening in an opening 102 of the slide 16*a*. The second shaft part 26*a* is connected to the crown 8*a* and is guided such that it can be displaced in the axial direction therein. The second shaft part has an eyelet 104, by means of which it can be hung on a hook 106 of an extension arm. The second shaft part 26*a* is guided in the crown 8*a* via an arresting sleeve 108. For this purpose, the second shaft part 26*a* is provided with an axial slot 110 through which a bolt 112 engages, said bolt passing through the arresting sleeve 108 and being fastened in the crown 8*a*.

The rope 28*a* of the rope winch 22 in connected to the second shaft part 26*a*. When the umbrella is opened, the slide 16*a* is moved toward the second shaft part 26*a* until the shaft part engages in the opening 102 of the slide 16*a*. In this case, the shaft part 26*a* is drawn into the arresting sleeve 108 and the arresting sleeve 108 is fitted over a pin 114 of the extension arm, said pin bearing the hook 106 on which the shaft part 26*a* is hung. The umbrella is thus arrested against undesired release and pivoting on the pin of the extension arm.

Figure 7:
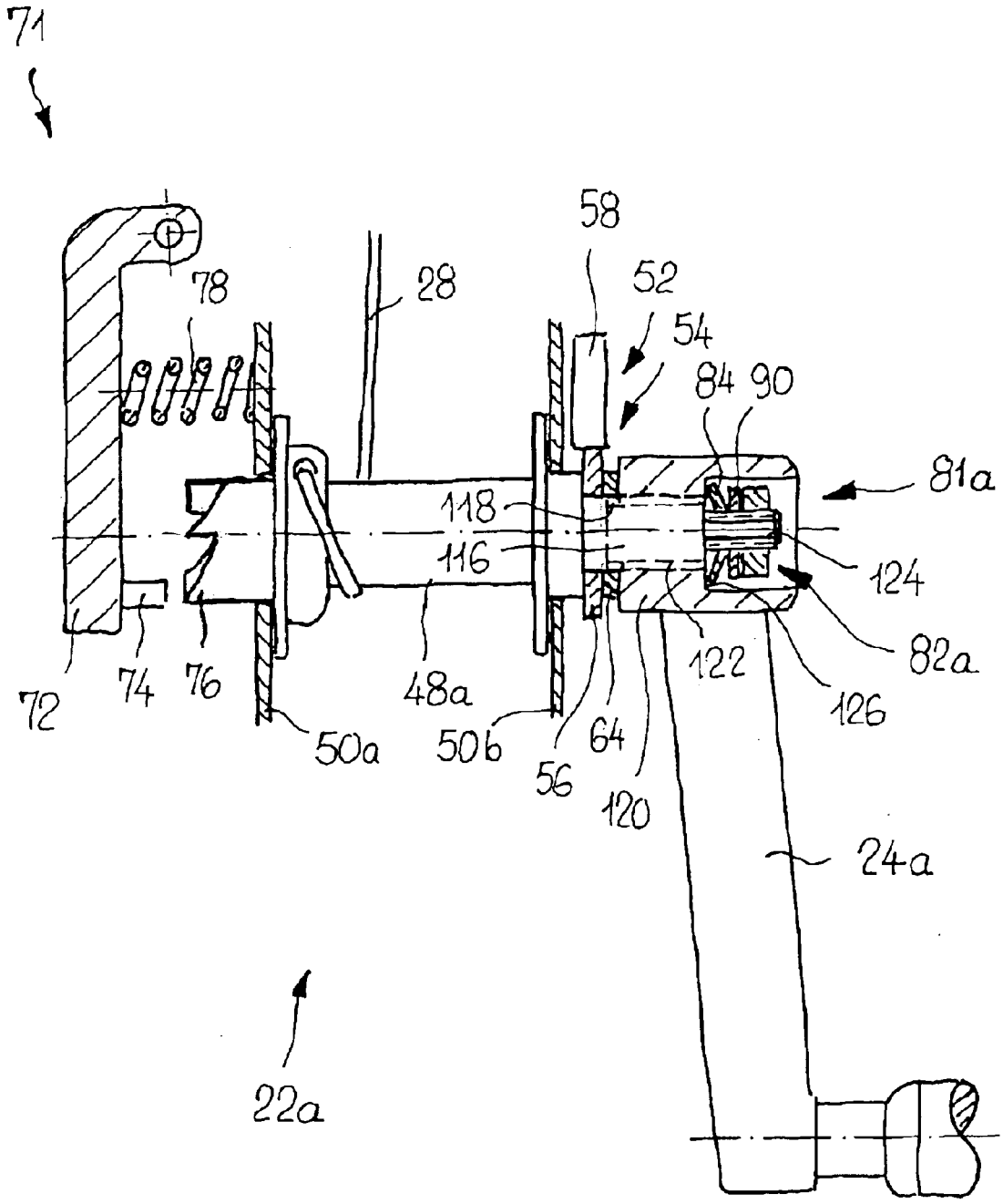
FIG. 7 shows a further rope winch.

FIG. 7 shows a further rope winch 22*a*, which is a modification of the rope winch 22 from FIGS. 3 and 4, so that the same parts are provided with the same designations. The rope drum 48*a* for the rope 28, said drum being mounted in the bearing plates 50*a*, 50*b* of the housing, has an axial journal 116, which bears the latching device 52 with the latching ring 56, the braking device 54 with the brake disk 64 and, via a threaded connection, the hand crank 24*a*. For this purpose, the axial journal 116 is provided with an external thread 118 and a hub 120 of the hand crank 24*a* is provided with an internal thread 122. Furthermore, the axial journal 116 contains the blocking device 81*a*. This is formed by an axial extension 124, on which is arranged the stop 82*a* in the form of a nut which, via a securing ring 90 and a spring 84, interacts with an end side 126 of the hub 120 of the hand crank 24*a*. The rope winch 22*a*, furthermore, is equipped with the free-running device 71, which contains the free-running button 72, which is prestressed into the FREE position by means of prestressing springs 78 and, by means of the retaining pin 74, interacts with the arresting profile 74 of the rope drum 48*a* in the manner which has already been described above.

The rope winch 22*a* functions in a manner analogous to the rope winch 22 from FIGS. 3 and 4, that is to say, when the umbrella is opened, the hand crank 24*a* is rotated in the clockwise direction and, under the influence of the counteracting rope force, is screwed, via the external thread 118, onto the internal thread 122 of the axial journal 118 and, in the process, presses the hub 120 of the hand crank 24*a*, via the brake disk 84, against the latching ring 56 of the latching device 52 until the driving force of the hand crank is greater than the tensile force of the rope, with the result that the latching ring 56 and the rope drum 48*a* are carried along and wind up the rope 28. When the umbrella is closed, the hand crank 24*a* is rotated in the anticlockwise direction, as a result of which the threaded connection, under the arresting influence of the latching device 52 between the hand crank 24*a* and the rope drum 48*a*, is released and the braking device 54 acts as a slip clutch and the cable 28 can run off from the rope drum 48*a* in a controlled manner. In order to achieve the free running of the rope 28, it is necessary to actuate the free-running button 72 of the free-running device 71, which acts on the arresting profile 76 by means of the retaining pin 74 and retains the rope drum 48*a* in an arrested state. Thereupon, the hand crank 24*a* can be rotated back until the end side 126 of the hub 120 of the hand crank 24*a* is positioned on the stop 82*a* of the blocking device 81*a*, as a result of which the braking device 54 and thus the latching device 52 are released and it is possible for the rope drum 48*a*, upon release of the free-running button 72, with the hand crank 24*a* being carried along, to rotate freely and for the rope 28 to run off freely without obstruction and, finally, for the umbrella to close without obstruction. The blocking device 81*a* is only released again when the hand crank 24*a* executes an opening movement in the clockwise direction and the rope force which increases in the process releases the blocking and thus activates the braking device 54 and the latching device 52.

What is claimed is:

1. Umbrella shaft assembly for a hanging umbrella, having a shaft part (20,20*a*), a second shaft part (26,26*a*) and a rope drive (22,22*a*) having a rope which connects a slide (16,16*a*) and a crown (8,8*a*), the slide and the shaft part (20,20*a*) being coupled axially to one another when the assembly is open, characterized in that the rope drive comprises a rope winch (22,22*a*) which is relatively fixed to the slide (16,16*a*), the rope (28,28*a*) running essentially coaxially with the axis (35) of the umbrella shaft assembly.

2. Umbrella shaft assembly according to claim 1, characterized in that the rope winch (22,22*a*) is arranged on the shaft part (20,20*a*), which is of hollow design and connected to the slide (16,16*a*).

3. Umbrella shaft assembly according to claim 1, characterized in that the second shaft part (26,26*a*) is connected to the crown (8,8*a*) of the umbrella (2,2*a*).

4. Umbrella shaft assembly according to claim 1, characterized in that the rope winch (22,22*a*) is arranged on the shaft part (20,20*a*), which is of hollow design and is connected to the slide (16,16*a*) and in that the second shaft part (26,26*a*) is connected to the crown (8,8*a*) of the umbrella (2,2*a*) and further characterized in that one of the shaft part (20) and the second shaft part (26) has a profiled pin (32) which interacts with a bushing (34) with corresponding mating profile (36) in the other of the shaft part (20) and the second shaft part (26).

5. Umbrella shaft assembly according to claim 1, characterized in that the rope winch (22,22*a*) is provided with a hand crank (24,24*a*).

6. Umbrella shaft assembly according to claim 5, characterized in that the rope winch (22,22*a*) has a latching device (52) and a braking device (54) which are combined with one another and can be operated by the hand crank (24,24*a*).

7. Umbrella shaft assembly according to claim 6, characterized in that the hand crank (24,24*a*) is connected, via a threaded connection (68,70,118,122), to a rope drum (48, 48*a*) which is mounted in a housing (40) of the rope winch (22,22*a*) and is latched by means of the latching device (52), comprising a latching ring (56), which is rotatable on the rope drum (48,48*a*), and a detent (58) on the housing, the latching ring (56) being connected axially to the hand crank (24,24*a*) via a brake disk (64) such that, during the opening movement of the hand crank (24,24*a*) in the clockwise direction, the brake disk (64) is pressed against the latching ring (56) by means of the threaded connection (68,70,118, 122), and blocks said latching ring, and that, during the closing movement of the hand crank (24,24*a*) in the anti-clockwise direction, the pressing action on the brake disk (64) is loosened in the manner of a slip clutch, with the result that the rope (28,28*a*) unrolls from the rope drum (48,48*a*).

8. Umbrella shaft assembly according to claim 7, characterized in that the hand crank (24) is fastened on a spindle (46) which is guided coaxially through an opening (66) of the rope drum (48) and is screwed, via an external thread (68), to an internal thread (70) of the rope drum (48).

9. Umbrella shaft according to claim 7, characterized in that the rope drum (48*a*) is an axial journal (116), which has the latching ring (56), the brake disk (64) and a threaded stub for the hand crank (24*a*).

10. Umbrella shaft assembly according to claim 6, characterized in that a rope drum (48,48*a*) is mounted in a housing (40) of the rope winch (22,22*a*) and the latching device (52) is assigned a free-running device (71) with a free-running button (72) which is operated from the outside of the housing (40) and has a retaining pin (74), which is movable in against an arresting profile (76) of the rope drum (48,48*a*), in order to block the rope drum (48,48*a*) until the braking device (54), as the closing movement of the hand crank (24,24*a*) progresses, becomes inoperative.

11. Umbrella shaft assembly according to claim 10, characterized in that the free-running device (71) has a stop (82,82*a*) against which the hand crank (24,24*a*) is positioned with blocking action as the closing movement progresses and the braking device (54) is released.

12. Umbrella shaft assembly according to claim 11, characterized in that the stop (82) is arranged on an axial extension (80) of a spindle (46) and interacts with an end side (86) of the rope drum (48) via a spring (84).

13. Umbrella shaft according to claim 11, characterized in that the stop (82*a*) is arranged on a part of an axial journal (116) of the rope drum (48*a*) which is directed away from the rope drum (48*a*) and the hand crank (24*a*).

14. Umbrella shaft assembly according to claim 1, characterized in that the rope winch (22,22*a*) has a releasable latching device (52) for opening the umbrella (2,2*a*) in a latched manner.

15. Umbrella shaft assembly according to claim 1, characterized in that the rope winch (22,22*a*) has a releasable braking device (54) for closing the umbrella (2,2*a*) in a controlled manner.

16. Umbrella shaft assembly according to claim 1, characterized in that, at its end which bears the rope winch (22,22*a*), it has a handle (38), which preferably extends downward from the rope winch (22,22*a*) and is aligned perpendicularly to a spindle (46) of the rope winch (22,22*a*).

17. Umbrella shaft assembly according to claim 16, characterized in that the handle is of annular design.

18. Umbrella shaft assembly according to claim 1, characterized in that the second shaft part (26,26*a*) has means (94,112) for connection to the crown (8,8*a*) of the umbrella.

19. An umbrella shaft assembly according to claim 1 in combination with an umbrella.

20. Umbrella combination according to claim 19 having means for hanging the umbrella, characterized in that the rope (28,28*a*) is connected to the means (10,106) for hanging the umbrella.

21. Umbrella combination according to claim 19, the crown of which is hung by means of a ball-and-socket joint (10), characterized in that the second shaft part (26) has a threaded bolt (94) which is screwed into the crown (8) of the umbrella and is screwed against a ball head (100) of the ball-and-socket joint (10), in order to block or release the latter.

* * * * *